US006026918A

United States Patent [19]

Briese

[11] Patent Number: 6,026,918

[45] Date of Patent: Feb. 22, 2000

[54] ROOF BOLT BIT

[75] Inventor: Leonard Arden Briese, Harbor City, Calif.

[73] Assignee: Briese Industrial Technologies, Inc., Harbor City, Calif.

[21] Appl. No.: 08/947,505

[22] Filed: Oct. 10, 1997

[51] Int. Cl.[7] ..... E21B 10/58

[52] U.S. Cl. ..... 175/414; 175/420.1

[58] Field of Search ..... 175/414, 420.1, 175/426, 427, 428, 373, 392, 415

[56] References Cited

U.S. PATENT DOCUMENTS

| | | | |
|---|---|---|---|
| 1,640,644 | 8/1927 | Bullum | 175/373 X |
| 2,976,027 | 3/1961 | Allimann | 175/392 X |
| 4,313,506 | 2/1982 | O'Connell | 175/420.1 |
| 4,444,281 | 4/1984 | Schumacher, Jr. et al. | 175/426 X |
| 4,729,441 | 3/1988 | Peetz et al. | 175/414 X |
| 4,819,748 | 4/1989 | Truscott | 175/420.1 |
| 5,452,628 | 9/1995 | Montgomery, Jr. et al. | 175/420.1 X |

*Primary Examiner*—Frank Tsay
*Attorney, Agent, or Firm*—Don Finkelstein

[57] ABSTRACT

A roof bolt bit arrangement comprising a combination spade drill body having a rotational axis, a shank portion, a generally planar spade cutter portion with a pair of oppositely directed cutting edges extending radially of the axis, and at least one rotatable frusto conical cutter mounted on the shank portion with its cutting edge in the path of the maximum radial extent of each spade cutter portion cutting edge.

18 Claims, 3 Drawing Sheets

FIG. 1
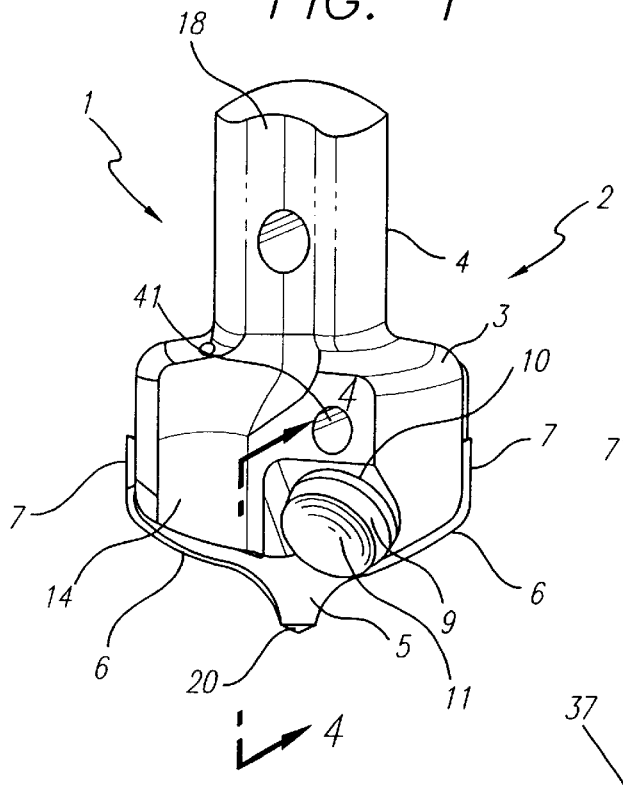
FIG. 2
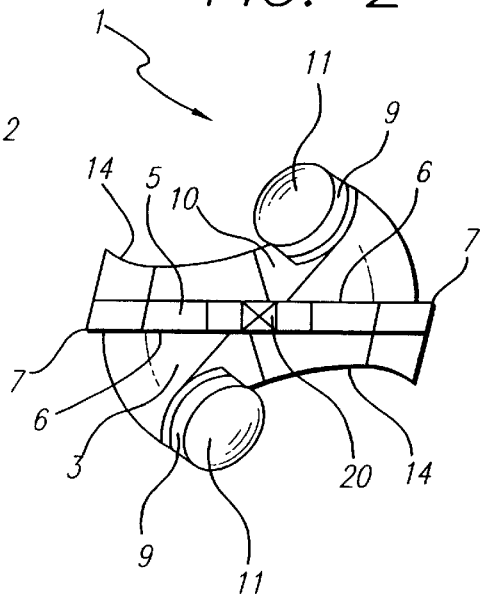
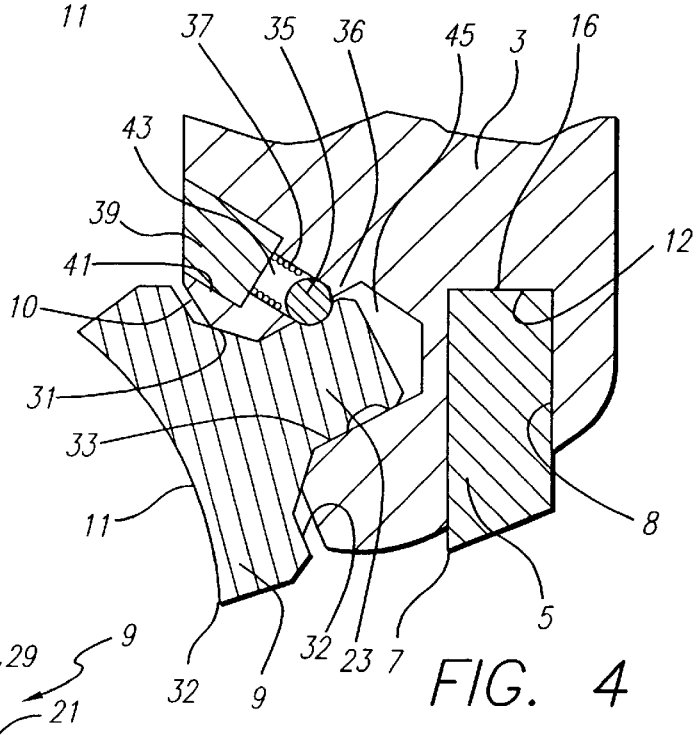
FIG. 4
FIG. 3
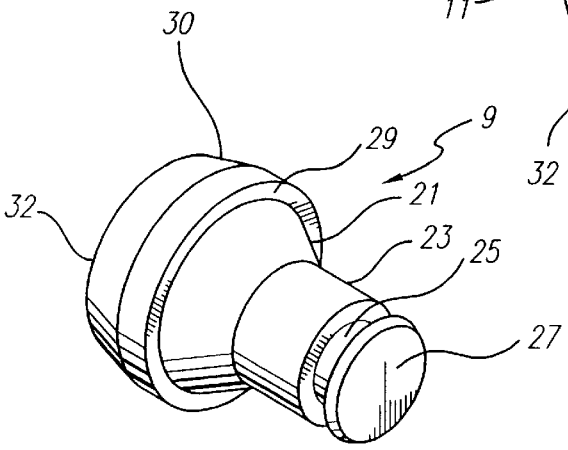

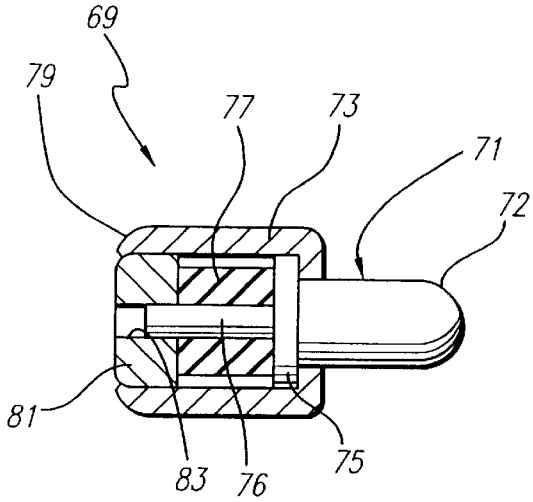
FIG. 9
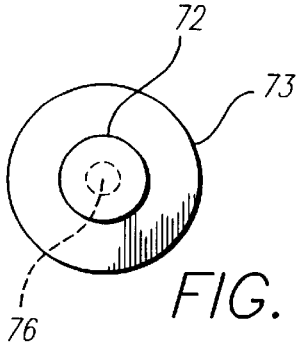
FIG. 10
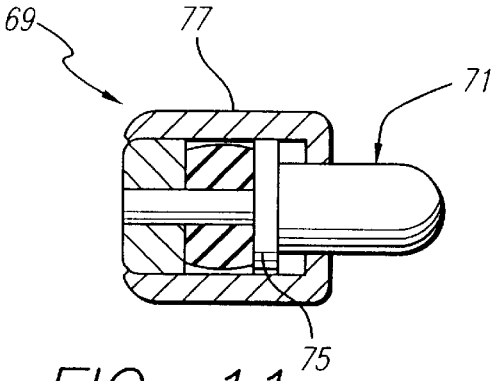
FIG. 11
FIG. 8
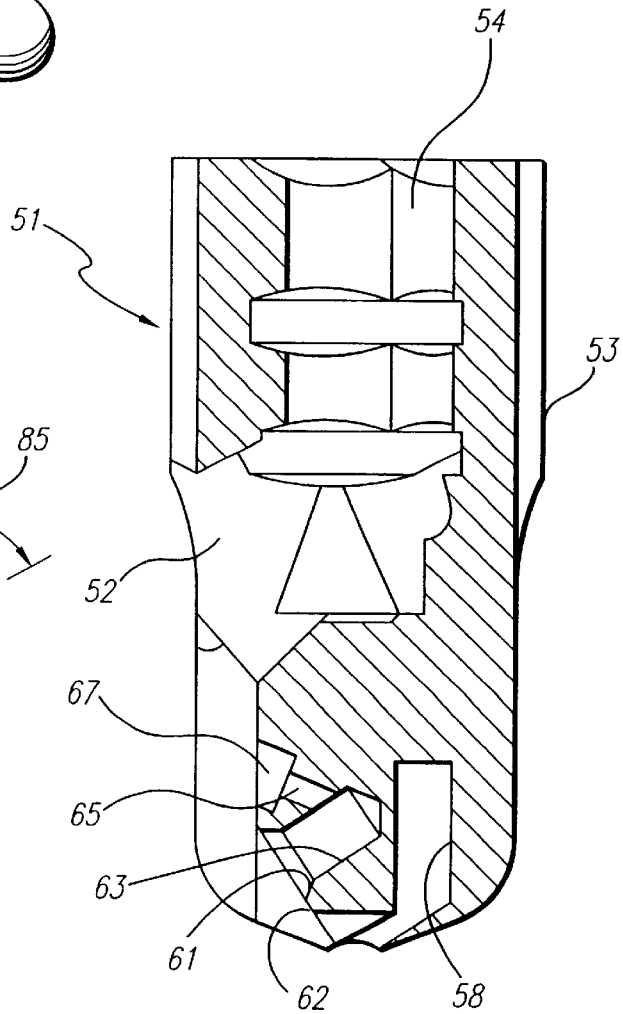
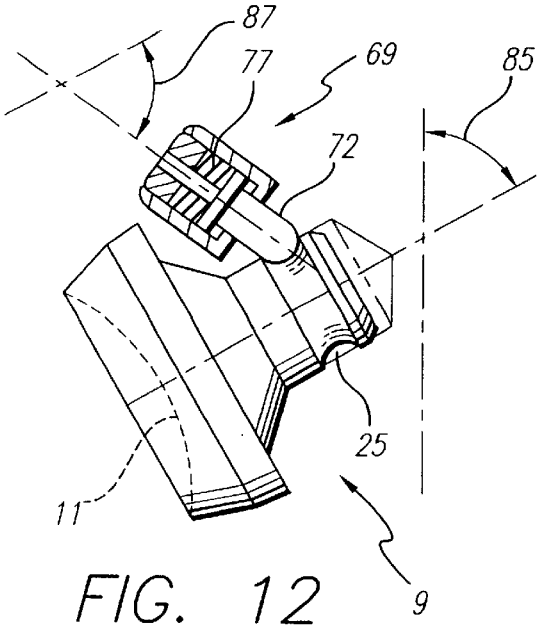
FIG. 12

ROOF BOLT BIT

BACKGROUND OF THE INVENTION

1. Field of the Invention

The present invention relates to the field of rotary spade drills, and in particular to a rotary spade drill arrangement with improvement features which greatly extend the life of a rotary spade drill of the type having a blade with transverse cutting edges extending from a central portion of the drill tip radially outwardly.

2. Brief Description of the Prior Art

Drills adapted to bore through rock are well known and documented in the art. For example, drills for the installation of roof bolts in mines and the like have a hardened tungsten carbide blade mounted transversely on the distal end of an elongated drill shank. The body of the drill may also have access ports communicating with the interior of the bore for purposes of flowing water or applying a vacuum to remove dust and cuttings from the vicinity of the cutting action in the bore. The blades of such drills are adapted to bore a hole having a diameter of approximately one inch and larger into the hardened stone roof or earth strata of the walls of a mine.

In the distant past, it was common to forge a drill from hardened material or substance such that the distal end of the drill was shaped in a generally planar spade-like configuration with transverse cutting edges leading from a central point of the drill to the outer periphery of a cutting circle which the drill makes in the material or substance to be drilled.

An improvement of that basic structure has been proposed in the prior art in the form of attaching a spade drill blade in a slot at the distal end of a drill body by brazing or by some sort of a fastener. This permits the spade-like blade to be made of a hardened material or substance, while the drill body may be made of a softer, less expensive, material.

The blades of such drills are subjected to extreme forces causing stresses within the blade which frequently result in breakage of the blade and failure of the drill, and in particular, causes wear especially at the outer radial portions of the cutting edge of the blade insert. Such wear is caused by a number of factors, including improper alignment of the blade on the distal end of the drill body, excessive thrust being applied to the blade during the drilling operation, heat generated by the fact that the cutting edge of the spade insert is, at all time, in contact with the material or substance being drilled without any opportunity for cooling. Abrasion, frictional, and impact wear are also major causes of drill failure.

Attempts have been made in the past to achieve the goals of the present invention, but their efforts have fallen short of providing satisfactory results. For example, U.S. Pat. Nos. 5,287,937 and 5,458,210 to Sollami et al. show a drill with a blade insert having features which serve to centrally locate the cutting blade in the longitudinal recess of a drill body, but the cutting edges of the insert are of traditional shape and are thus subject to traditional wear and damage as described above.

Other examples of providing a spade blade insert into a receiving drill body can be found by reference to U.S. Pat. Nos. 4,086,972 to Hansen et al.; 4,817,742 to Whysong; 4,819,748 to Truscott; and 3,049,033 to M. L. Benjamin et al. While all of these prior art patents relate to spade drill insert arrangements, and while suggested improvements in blade cutting edge design and attachment means between the blade and the body of the drill are offered, none of these prior art references suggest any solution for the problem of wear of the cutting edges of a spade drill, especially toward the outer radial surfaces thereof.

U.S. Pat. No. 4,627,503 to Horton attempts to solve the wear problem by providing a multi-layer spade cutting insert comprising a polycrystalline diamond center layer portion and outer metal side portions. When used as an insert in a spade drill, the cutting element, while extending the life of the drill due to the presence of the polycrystalline material, the cutting edges must nevertheless be repeatedly resharpened, as mentioned in this prior art patent. Polycrystalline tool materials are very delicate and are very subject to impact chipping and breakage.

Attempts have also been made in the prior art to employ rotating discs to assist in the cutting action of a drill, examples being found in U.S. Pat. Nos. 1,692,919 to W. C. Bailey, and 1,790,613 and 1,812,475 to A. M. Gildersleeve et al. However, the rotary cutting discs as described in these prior art patents define the cutting edges of the drill devices themselves, i.e. they are not associated with any other drill cutting edges in combination.

It would be desirable to provide a rotary spade drill arrangement which would reduce cutting forces for the same rate of cut to thereby reduce the required thrust bearing forces, and to reduce the incidences of failure of the drill by extending the life of the drill several times over the life of a standard transverse edge spade drill arrangement.

SUMMARY OF THE INVENTION

The present invention overcomes the aforementioned problems and disadvantages with the prior art drill devices by providing a rotary spade drill arrangement comprising a combination spade drill body having a rotational axis, a shank portion, a generally planar spade cutter portion with a pair of oppositely directed cutting edges extending radially of the axis, and at least one rotatable frusto conical cutter is mounted on the shank portion with its cutting edge in the path of the maximum radial extent of each spade cutter portion cutting edge. In a preferred embodiment, the spade cutter portion comprises a spade insert mounted to the shank portion. The shank portion may have a constant width dimension axially, or it may have a relatively large width dimensioned body part and a relatively small width dimensional shaft. For purposes of description herein, the planar spade cutter portion, whether integral with the spade drill body or fabricated as a separate structure for insertion in the spade drill body, may be considered to have a general plane extending parallel to the planar sides of the spade drill cutter portion and containing the point or apex of the spade drill.

The zero plane of the frusto conical cutter cutting edges are made coincident with the plane of the cutting paths of the spade cutter insert cutting edges, adjacent the maximum radial extent of the spade cutter insert edges, therefore, as utilized herein, the "zero plane" of the frusto conical cutter cutting edges is defined as the planes containing the cutting edges of the each of the frusto conical cutters. In this way, the cutting edges of the rotatable frusto conical cutters cut material or substance which would otherwise be cut by the most extreme radial cutting edge of the spade insert.

Since the frusto conical cutter is rotatable, and since the forces applied to the face of the frusto conical cutter during a cutting action tend to rotate the cutter, a fresh portion of the cutting edge is always presented at the maximum radial extent of the spade insert. This not only provides for a greatly extended life of the cutting edge at the extreme radial ends of the spade cutter by exposing the material or substance to be cut with a continuously fresh cutting edge, but due to the rotation of the frusto conical cutter, the cutting edge making a cut is immediately rotated out of position so as to have time to cool before it is brought back into cutting engagement with the material or substance to be cut. Both of these features of a rotatable frusto conical cutter greatly increase the life of the rotary spade drill arrangement.

Another major feature of the invention is that it forms a true constant diameter hole over the life of the spade drill. With prior art spade drills, the forward portion of the side edges of the cutter wear faster than those at the rearward portion.

As a result, the spade cutter becomes tapered, making a tapered hole due to such drill wear, and drill seizure in the tapered hole often results. The cutting edge of a conical skirt in a frustum cutter, as in the present invention, performs as a reamer maintaining a true constant diameter hole and avoiding seizure.

Other important features include reduced frictional, abrasive, and impact wear or chipping, reduced heat, higher rotating speeds, higher feed rates, and higher productivity rates.

Thus, the present invention provides the advantages of a frusto conical cutter in combination with the ideal spade drill insert arrangement for drilling holes in stone, metal, or other hard substances. As compared with the common transverse spade drill cutting insert, the addition of a rotatable frusto conical cutter mounted on the shank or body portion adjacent each spade cutter cutting edge results in stronger cutting edges, less thermal deformation, greater heat dissipation, heavier feeds, more efficient cutting action, reduced horsepower of the driving force, reduced part deflection, reduced entry shock, reduced cutting forces, more stability and positive mounting position of the cutting edges of the rotary spade drill arrangement, and improved surface finishing when used for surfacing work-hardened materials or substances.

BRIEF DESCRIPTION OF THE DRAWING

Further objects and advantages and a better understanding of the present invention may be had by reference to the following detailed description taken in conjunction with the accompanying drawings in which:

FIG. 1 is a perspective view of a roof bolt bit arrangement employing a rotatable frusto conical cutter mounted on the larger dimensioned body part of the roof bolt bit;

FIG. 2 is a bottom end view of the roof bolt bit arrangement of FIG. 1;

FIG. 3 is a side perspective view of a rotatable frusto conical cutter;

FIG. 4 is a cross sectional view taken along the line 4—4 in FIG. 1;

FIG. 8 is a cross sectional view taken along the line 8—8 in FIG. 5;

FIG. 9 is a partial cross sectional view of an alternate form of a frusto conical insert retainer;

FIG. 10 is a right end view of the retainer of FIG. 9;

FIG. 11 is the retainer device of FIG. 9 shown in the operating condition thereof; and FIG. 12 is a view of the structural and operating relationship between the retainer of FIGS. 9–11 and the rotary frusto conical cutter insert of FIG. 3.

DETAILED DESCRIPTION OF THE PREFERRED EMBODIMENTS

Figure 6:
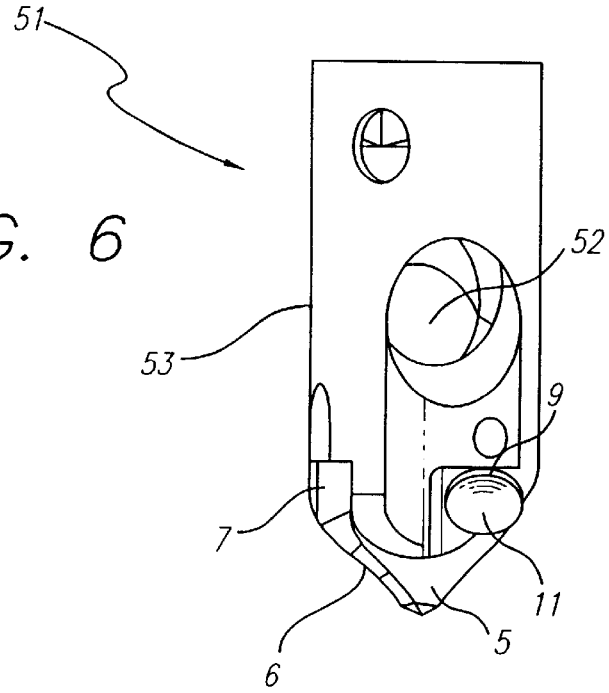
FIG. 6 is a side elevational view of the roof bolt bit arrangement shown in FIG. 5, but with a frusto conical cutter and spade insert attached.

FIGS. 1 and 2 show a perspective side view and cutting, or working, end view, respectively, of a rotary spade drill arrangement 1 having a spade drill body portion 2 comprising a spade cutting insert receiver portion 3 and a shank portion 4. A spade cutting insert 5 is fixed to the distal end of the spade drill body portion 2. The spade cutting insert 5 is shown to have radially directed cutting edges 6 slanted rearwardly toward the outer periphery of the insert 5, the radially directed cutting edges 6 curving rearwardly to form axially aligned side cutting edges 7. On the female receiver portion 3, at the furthest radial location, and on opposite sides of spade cutting insert 5, is positioned or formed a platform, or angled surface 10, supporting a rotatable frusto conical cutter insert 9. This depiction of one aspect of the present invention provides the aforementioned advantages, greatly prolonging the life of the spade cutting insert 5 for the reasons mentioned.

Figure 5:
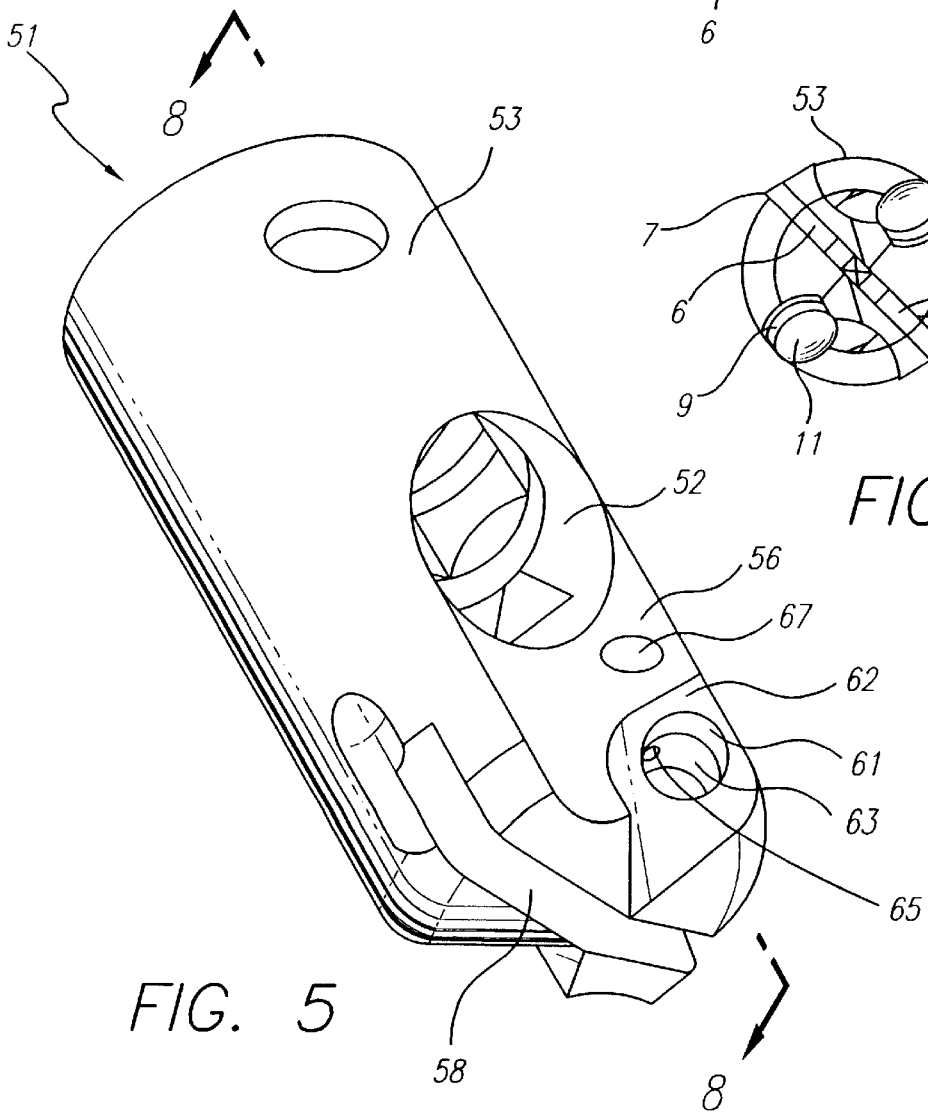
FIG. 5 is a perspective view of an alternate embodiment of a roof bolt bit arrangement without a frusto conical cutter and spade insert attached.

Referring more generally to FIGS. 2–5, a preferred embodiment of the invention is shown in which the spade cutting insert receiver 3 accepts and securely holds a spade cutting insert 5. The spade drill body portion 2 comprises the shank portion 4 and the female insert receiver portion 3. As best seen in the cross sectional view of FIG. 4, the insert receiver portion 3 has a slot 8 traversing the insert receiver portion 3 along its entire width, the slot 8 ending in a bottom wall 12. The spade cutting insert 5 is securely received in slot 8 by taper lock, rivets, press fit, or other known means. As shown clearly in FIGS. 1, 2 and 4, the side cutting edges 7 of the spade cutting insert 5 are on portions thereof which extend radially outwardly from the adjacent portions of the insert receiver portion 3 of the body portion 2. FIG. 4 also illustrates that the zero plane of the frusto conical cutting insert 9 contains a cutting edge 32 and, as the spade drill body portion 2 rotates, the zero plane of the frusto conical cutter 9 at any position during rotation is coincident with the plane containing the cutting paths of the spade cutting insert 5 adjacent the maximum radial extent of the cutting edges 6, 7 thereof.

In order to accommodate the rotatable frusto conical cutting inserts 9, and permit unrestricted cutting action by inserts 9, a cutaway 14 is provided on opposite sides of the receiver portion 3, each cutaway 14 leading to a platform 10 and providing a backing support for the axially directed cutting edges 7 of the spade cutting insert 5.

When spade cutting insert 5 is positioned in slot 8, and secured in place, the upper linear machined surface 16 of the spade cutting insert 5 surface contacts the machined bottom wall 12 of slot 8 in the female insert receiver portion 3, the contacting surfaces 12 and 16, in combination with the chosen mounting means, providing a secure and tight fit for the spade cutting insert 5 into the female insert receiver portion 3 and providing precise positioning of the cutting edges 6, 7.

By reference to FIG. 1, it will be observed that the shank portion 4 may have axial channels 18 formed on each side thereof, whereby fluid may be passed, or a vacuum may be provided for the removal of dust and small particles from the material or substance being cut.

As will be observed by reference to FIGS. 1 and 4, the outer lateral edges 7 and the bottom radial edges 6 of the spade cutting insert 5 are provided with sharp cutting edges for the rotary spade drill arrangement. Where the converging, substantially radial cutting edges 6 meet at the bottom central region of the spade cutting insert 5, as shown in FIGS. 1 and 2, a pyramidal-shaped point 20 is formed. The shape of the pyramidal point 20 provides four cutting edges, as opposed to the typical spade drill cutter inserts which have only one or two cutting surfaces. A pyramidal-shaped end point 20 thus provides advantages over one-edge or two-edge points of the prior art, by at least doubling the impact frequency and cutting/drilling efficiency of the tip in a starting hole, and by subjecting any particular cutting edge to the material or substance to be cut with greatly reduced stress.

The side elevation view of FIG. 1, aided by the cross sectional view of FIG. 4, shows the completely assembled rotary spade drill arrangement, depicting the downward angle of the rotatable frusto conical cutter insert 9, the shape of the platforms 10, and the orientation of the shaft of the rotatable frusto conical cutter 9.

FIG. 3 is a side view of a rotatable frusto conical cutter insert 9, and FIG. 4 is a fragmentary cross sectional view showing a rotatable frusto conical cutter insert 9 mounted in insert receiver 3. The frusto conical cutter insert 9 has a frusto conical nose portion 30 tapering forwardly to the cutting edge 32 formed by the converging surfaces of the outer frusto conical surface 30 and the concave cutter face 11. Extending rearwardly from the center of the nose portion 30 is a conical bearing surface 21 in surface bearing contact with a complementary conical shaped bearing surface 31 in receiver 3. Preferably, the contacting bearing surfaces are treated with a diamond coating, available from QQC, Inc. of Dearborn, Mich., to reduce the sliding friction between the mating conical surfaces.

With reference to FIGS. 3 and 4, a cylindrical shaft 23, having a chamfered end 27, and an intermediate annular groove 25, extends rearwardly from the conical surfaced portion 21. Shaft 23 is removably inserted into a bore 33 formed in the body of receiver 3. A spring biased retainer ball 35 is shown biased angularly rearwardly against shaft 23 and lies partially within annular groove 25 in shaft 23, thereby retaining and preloading the rotatable insert 9 in the body of receiver 3, leaving an end gap 45 as shown in FIG. 4.

To remove inserts 9, a bladed tool can be inserted between the nose 30 and receiver body 3, and the insert 9 can thus be pried out, the retainer ball 35 being pushed against the force of spring 37 until it rides over the rear wall of groove 25. To assist in this procedure, the rearward walls of annular groove 25 may be slightly angled or rounded as shown in FIG. 4, thereby making it easier for the walls of groove 25 to cam the retainer ball 35 outwardly.

In a preferred embodiment, the ball 35 and spring 37 are inserted into a passageway 43 in the body of receiver 3. A plug 39 is then press fit or swaged into a bore 41 to maintain ball 35 and spring 37 in position. The depth of bore 41 and the spring characteristics are chosen so as to provide a predetermined retention force and a predetermined preload force between conical surfaces 21 and 31. To keep balls 35 from falling into bore 33 when the frusto conical insert 9 is removed, a ball stop 36 is formed at the end of passageway 43.

The nose portion 30 of the frusto conical cutter insert 9 may have formed therein sharp-edged grooves or flutes (not shown). Such sharp-edged grooves or flutes aid in chipping away the material or substance being cut by the cutting insert, in providing breaking of chips in metal removal, in moving small particles away from the cutting/drilling process, and in providing forced rotation of rotary cutting inserts. It is to be understood that the design of the frusto conical cutter inserts shown in the accompanying figures are for illustrative purposes only, and any of a variety of patterns of sharp cutting edges on the cutting insert faces can be formed, as desired. For example, instead of V-grooves, facial sharp edges for the cutting insert may be formed as boss projections, diamond shaped grooves, radial grooves, axially angular grooves, helical grooves, tapered grooves, or grooves in a feathered pattern or in a chevron pattern, any such grooves being straight or curved as desired, to name a few.

As mentioned, if the forward edges of annular groove 25 are chamfered or beveled slightly, the cutter insert 9 may be removed by prying the nose portion 30 away from the sloped surface of platform 10, and this can be done without requiring removal of the rotary spade drill arrangement from the drive apparatus. Similarly, a fresh replacement frusto conical cutter 9 may easily and quickly be inserted. The chamfered end 27 of shaft 23 is effective to push back the retainer ball 35 against spring 37 upon installation of a fresh frusto conical cutter 9, until the spring biased ball 35 snaps into annular groove 25, completing the installation of the fresh or alternate type cutter insert 9.

Preferably, the ball 35 and the ball contacting surfaces on cutter insert shaft 23 are treated with a diamond coating, available from QQC, Inc. of Dearborn, Mich., to reduce the sliding friction between the mating surfaces.

Figure 7:
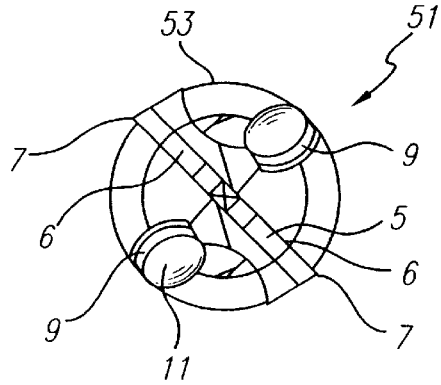
FIG. 7 is a bottom end view of the arrangement shown in FIG. 6.

FIGS. 5–8 illustrate a second preferred embodiment of the invention. In this embodiment, the roof bolt bit 51 is of the center vacuum rotary drill bit style having a spade cutting insert 5 mountable in a slot 58 in the working end of a tubular member 53 which may be either the tubular, rotary powered drill shaft, or may be a separate tubular member adapted for connection to a conventional rotary drive shaft. For the latter application, an axial bore 54 of polygonal cross section is formed in the end of the cutter bit opposite the working end.

Dust collection openings 52 are provided on each side of the tubular member 53, and leading from the working end of the bit 51 to the dust collection openings 52 is a recessed portion defined by planar side surfaces 56 which acts as a conduit for dust and the like to flow from the material or substance being drilled to the dust collection openings 52.

A spade cutting insert 5 is mounted to the working end of the tubular member 53 in the same manner as that described in connection with FIGS. 1–4. Similarly, in order to accept a rotary frusto conical cutting insert 9, platforms, or sloped surfaces, 62 are provided in the body of tubular member 53, one positioned on each side of the cutting insert 5. As with the embodiment of FIGS. 1–4, the cylindrical drill body portion, or member, 53 has a pair of shaft bores 63, and a pair of conical bearing surfaces 61, formed in the platform 62. A passage way 65 is provided to accept a spring biased ball or plunger arrangement for retaining a frusto conical cutter 9 in place and to apply preload forces against the bearing surfaces 21, 61. A plug 67 is press fit in place in a manner similar to that described in connection with plug 39 shown in FIG. 4.

FIGS. 9–12 relate to an alternative form for the retention/preload arrangement 69. That is, as opposed to providing a ball movable in a passage in which a compression spring applies force to move the ball toward the end of the passageway and into groove 25 of the cutting insert 9, a self-contained resilient retainer and preload device 69 may be employed. In FIGS. 9–12, a plunger 71 having a rounded nose 72 is contained within and slidable within a casing body 73. An annular resilient member 77 encompasses a rear shaft 76 of plunger 71, the resilient member 77 being retained within casing 73 by an annular end cap 81. End cap 81 is held fixed at the rear end of casing 73 by tapered ends 79. End cap 81 has a central opening 83 for movement of the shaft 76 therein. Plunger 71 is prevented from moving forward out of casing 73 by the provision of a flange 75 as shown.

FIG. 9 is the relaxed condition of the retention/preload device 69, and in the embodiment shown in FIGS. 9, 11, and 12, the annular resilient member 77 takes the form of a neoprene annulus. It will be understood that this is only one example of a resilient member, and a compression spring, a series of Belville springs, and other mechanical spring devices may be substituted with equal functioning characteristics. In any event, the resilient nature of the neoprene "spring" 77 pushes the plunger 71 fully out of casing 73 until flange 75 abuts the inner end surface of casing 73. The entire self-contained retention/preload device 69 may then be press fit into a passageway 43, 65 to a depth predetermined to give the optimum force against the rear walls of annular groove 25 and to provide preload forces between the mating conical surfaces of the cutting insert 9 and body bearing surfaces 31, 61. After insertion into passageway 43, 65, if desired, plug 39 and 67 may be replaced by 69 assembly.

FIG. 10 is the right end view of the device 69 shown in FIG. 9, and FIG. 11 is a partial cross sectional view, similar to that of FIG. 9, but with the resilient annular neoprene member 77 in compression due to plunger 71 being forced rearwardly, FIG. 11 showing the flange 75 having been moved rearwardly to effect the compression of the resilient member 77.

FIG. 12 is a rather schematic view of the retention/preload device 69 in relationship to the rotary frusto conical cutting insert 9. As shown in FIG. 12, the preferred angle 85 for the axis of cutting insert 9 relative to the axis of the roof bolt bit is 60°. Also, the preferred angle 87 between the axis of the retention/preload device 69 and the axis of the frusto conical cutting insert 9 is 30°.

It will be understood that all of the features regarding removal and replacement of a cutting insert 9 is possible with the retention/preload device 69 the same as was described in connection with the spring and ball device of FIGS. 1–4.

In the embodiment shown and described, it was implied that the sloped platforms 10 were integrally formed with the spade cutting insert receiver 3. Obviously, other means of supporting a rotatable frusto conical cutting insert 9 than the platforms 10 as shown would come to the mind of a skilled worker, once the need for such a platform is made known.

Moreover, various methods may be utilized to retain the spade cutting insert 5 in the female insert receiver portion 3, 53, other than by the press fit embodiment shown and described in connection with the preferred embodiments. For example, the insert 5 may be fixably attached to a drill body portion 2, 53 by means of screws, retainer pins, or by means of a taper locking fit between the spade cutting insert 5 and the slot 8, 58 for receiving the spade cutting insert. Such a taper lock system is described in my copending application entitled "TAPER LOCK ARRANGEMENT", filed Aug. 01, 1997, and bearing Ser. No. 08/905,038.

It will also be understood that the various features of the invention described in connection with a rotary spade drill arrangement employing replaceable rotatable frusto conical cutter inserts have novel and nonobvious characteristics of their own. Accordingly, such features of the invention are to be considered independently inventive from the rotary spade drill arrangements employing rotatable frusto conical cutter inserts.

While only certain embodiments have been set forth, alternative embodiments and various modifications will be apparent from the above description to those skilled in the art. For example, other constructions for a biasing means to retain the frusto conical cutting inserts 9 in place and provide a predetermined amount of bearing surface preload can be employed without departing from the application of the concepts in accordance with the present invention. These and other alternatives are considered equivalents and within the spirit and scope of the present invention.

What is claimed is:

1. A roof bolt bit arrangement, comprising:

a spade drill body portion having a rotational axis, a forward end, a pair of spaced apart, opposite side surface portions and a generally planar spade cutter portion having generally planar side surfaces with a pair of oppositely directed cutting edges extending radially of said axis, and having a general plane containing said axis and said general plane substantially parallel to said planar side surfaces, said spade drill body portion having at least one opening exposing an interior conical bearing surface adjacent the maximum radial extent of each said cutting edge;

a rotatable frusto conical cutter mounted on said drill body portion in said opening, said cutter having an exterior conical bearing surface in bearing relationship with said interior bearing surface; and a retainer for fixing said rotatable frusto conical cutter axially relative said spade cutter portion.

2. The roof bolt bit arrangement as claimed in claim 1, wherein one of said rotatable frusto conical cutters is rotatably mounted on each of said pair of spaced apart, opposite side surface portions of said drill body portion, and each of said rotatable frusto conical cutter has an axis and a coaxial circular cutting edge, and each of said frusto conical cutters having a zero plane containing said coaxial circular cutting edge thereof and the zero plane of said frusto conical cutter containing said cutting edges being coincident with the plane containing the cutting paths of said spade cutter portion cutting edges adjacent said maximum radial extent of said spade cutter portion cutting edges.

3. The roof bolt bit arrangement as claimed in claim 2, wherein said frusto conical cutter axes lie in planes parallel to each other and parallel to said spade drill body portion rotational axis and each said frusto conical cutter depends from the general plane of said spade cutter portion at an angle selected to provide a predetermined axial rake for said frusto conical cutter. platforms on opposite sides thereof upon which said rotatable frusto conical cutters are rotatably mounted.

4. The roof bolt bit arrangement as claimed in claim 3, wherein said drill body portion comprises a pair of angled platforms on one of said angled surface platforms on each of said pair of spaced apart opposite side surfaces upon which said rotatable frusto conical cutters are rotatably mounted.

5. The roof bolt bit arrangement as claimed in claim 4, wherein:

each said platform has a flat sloping surface angled from said general plane of said spade cutter portion to place the cutting edges of said frusto conical cutter at said predetermined axial rake; and each said frusto conical cutter axis is perpendicular to said platform flat sloping surface.

6. The roof bolt bit arrangement as claimed in claim 1, wherein:

each said rotatable frusto conical cutter has an axis, a forwardly directed coaxial circular cutting edge, and a rearwardly directed shaft with a forward conical shoulder;

said drill body portion has a pair of bores on opposite sides thereof for receiving the shafts of corresponding rotatable frusto conical cutters, said bores having a forward portion defining said interior conical bearing surface; and said axial retainer retains each said frusto conical cutter shaft in its corresponding bore.

7. The roof bolt bit arrangement as claimed in claim 6, wherein:

each said frusto conical cutter shaft has a rear distal end and is provided with an annular groove adjacent said rear distal end; and each said axial retainer comprises a spring biased movable member internally of said drill body portion and engageable within said frusto conical cutter shaft annular groove.

8. The roof bolt bit arrangement as claimed in claim 7, wherein:

said drill body portion has internal passageways within which said movable member freely passes; and said roof bolt bit arrangement further comprises compression spring in said passageway, and a plug on a side of said compression spring opposite said movable member; whereby said spring is under compression to bias said movable member into engagement in said frusto conical cutter shaft annular groove.

9. The roof bolt bit arrangement as claimed in claim 8, wherein said passageways are positioned at an angle with respect to the axis of its respective frusto conical cutter such that said movable member is biased to move its respective frusto conical cutter shaft rearwardly, further into said bore, thereby creating a preload bearing force between said interior and exterior conical bearing surfaces.

10. The roof bolt bit arrangement as claimed in claim 1, wherein:

said spade drill body portion comprises a shank part and a spade cutting insert receiver part; and said spade cutter portion defines a separate spade cutting insert receivable in said spade cutting insert receiver part.

11. The roof bolt bit arrangement as claimed in claim 10, wherein:

said spade cutting insert has side cutting edges; and said cutting edges extending radially of said spade drill cutter portion and said side cutting edges extend beyond adjacent portions of said spade cutting insert receiver part.

12. The roof bolt bit arrangement as claimed in claim 10, wherein each said rotatable frusto conical cutter has an axis and a coaxial circular cutting edge, the zero plane of said frusto conical cutter cutting edges being coincident with the plane containing the cutting paths of said spade cutter portion cutting edges adjacent said maximum radial extent of said spade cutter portion cutting edges.

13. The roof bolt bit arrangement as claimed in claim 1, wherein said spade cutting insert comprises a pyramidal point at the intersection of said cutting edges of said space cutter portion.

14. A roof bolt bit arrangement, comprising:

a drill body having a rotational axis, a shank portion, and a spade cutter portion with a pair of cutting edges extending laterally of said axis;

a rotatable frusto conical cutter mounted on said shank portion adjacent the maximum radial extent of each said cutting edge;

a retainer for fixing said rotatable frusto conical cutter axially relative to said shank portion; and a conical bearing arrangement comprising respective conical bearing surfaces on said rotatable frusto conical cutter and said shank portion.

15. The roof bolt bit arrangement as claimed in claim 14, wherein:

said spade cutter portion has side cutting edges, and said laterally extending edges and said side cutting edges extend beyond adjacent portions of said shank portion.

16. The roof bolt bit arrangement as claimed in claim 14, wherein said shank portion comprises a first diameter body part and a shaft part having a second diameter smaller than said first diameter and said shaft part engageable by a driving tool.

17. The roof bolt bit arrangement as claimed in claim 14, wherein said shank portion has shaft and body parts of substantially the same diameter, said shaft part has an axial opening the rein engageable by a driving tool.

18. A roof bolt bit arrangement comprising a combination spade drill body having a rotational axis, a shank portion, a generally planar spade cutter portion with a pair of oppositely directed cutting edges extending radially of the axis, and at least one rotatable frusto conical cutter mounted on the shank portion with its cutting edge in the path of the maximum radial extent of each spade cutter portion cutting edge.

* * * * *